US008308252B2

(12) United States Patent
Shimoda

(10) Patent No.: US 8,308,252 B2
(45) Date of Patent: Nov. 13, 2012

(54) INKJET PRINTER

(75) Inventor: Tomohiko Shimoda, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 181 days.

(21) Appl. No.: 12/975,789

(22) Filed: Dec. 22, 2010

(65) Prior Publication Data

US 2011/0242156 A1 Oct. 6, 2011

(30) Foreign Application Priority Data

Apr. 1, 2010 (JP) ..... P2010-085143

(51) Int. Cl.
*B41J 29/38* (2006.01)

(52) U.S. Cl. ..... 347/6; 347/7; 347/19

(58) Field of Classification Search ..... 347/5–7, 347/14, 17, 19, 84–87
See application file for complete search history.

(56) References Cited

U.S. PATENT DOCUMENTS 6,935,729 B2 * 8/2005 De Marco et al. ..... 347/6

FOREIGN PATENT DOCUMENTS

JP 2001-219580 A 8/2001
JP 2008-037020 A 2/2008

* cited by examiner

*Primary Examiner* — Juanita D Jackson
(74) *Attorney, Agent, or Firm* — Nath, Goldberg & Meyer; Jerald L. Meyer; Robert T. Burns

(57) ABSTRACT

Streams of ink being returned by a circulation pump from a lower tank through an upstream flow path block to an upper tank have viscosities higher than viscosities of streams of ink being supplied from the upper tank through a downstream flow path block to an inkjet head, there being a difference in flow rate of ink developed with attendant differences in viscosity between the upstream flow path block and the downstream flow path block, while being reduced by differences between heating efficiencies in the upstream flow path block and heating efficiencies in the downstream flow path block.

9 Claims, 8 Drawing Sheets

INKJET PRINTER

BACKGROUND OF THE INVENTION

1. Field of the Invention

The present invention relates to an inkjet printer provided with an ink circulation route, and particularly, to an inkjet printer adapted to supply ink from an ink tank to an inkjet head through an ink circulation route, with pressures corresponding to differences in water head of liquid level in between.

2. Description of Related Arts

There has been wide use of inkjet printers adapted to propel droplets of ink from an inkjet head onto a print sheet, to form images thereon. Among such inkjet printers, there have been those including an ink tank disposed in position higher than the inkjet head, and adapted to work in a state air-communicating with the atmosphere, to supply ink from the ink tank to the inkjet head.

There is an inkjet printer disclosed in Japanese Patent Application Laying-Open Publication No. 2001-219580, with configuration to supply ink to nozzles of an inkjet head with pressures corresponding to differences in water head relative to a liquid level of an ink tank, affording to control the liquid level of ink tank to supply stable pressures of ink to the nozzles. There is a flow of ink supplied to the inkjet head, having an excess of ink collected, and returned through a pump to the ink tank. The inkjet printer thus has an ink supply line of a circulation type configured to circulate ink from the ink tank, through the inkjet head, again to the ink tank.

By the way, for use in inkjet printers, available types of ink have tendencies to get the lower in temperature the higher in viscosity, as their properties. High viscosities of ink disable propelling ink droplets through nozzles at adequate discharge speeds. To this point, there is an inkjet printer with ink circulation route disclosed in Japanese Patent Application Laying-Open Publication No. 2008-37020, with configuration to work when the ink temperature is low, to heat ink to enable propelling ink droplets through nozzles at adequate discharge speeds.

SUMMARY OF THE INVENTION

The temperature of ink gets lower than adequate due to, for instance, some print mode interrupted by a long interval that keeps ink from circulating along an ink circulation route. There develop ink temperatures decreased to a variety of extents depending on various factors such as structures of the ink circulation route and the peripheries, or locations in the ink circulation route where ink is heated. Therefore, when heating ink lower in temperature than adequate, there is an interval of time elapsed for ink temperatures to be warmed up to adequate temperatures over the ink circulation route, with the possibility of having viscosities of ink varied depending on locations on the ink circulation route.

With viscosities of ink varied on the ink circulation route, there are flow rates of ink circulating along the ink circulation route, with variations depending on locations thereon. Such variations in flow rate of ink would make unstable the level of liquid surface in an ink tank air-communicating with the atmosphere, for instance, constituting a factor that causes air to be mingled in ink being supplied to an inkjet head.

The present invention has been devised with such issues in view. It is an object of the present invention to provide an inkjet printer adapted to supply ink from an ink tank air-communicating with the atmosphere to an inkjet head, through an ink circulation route, with pressures corresponding to differences in water head of liquid level in between, affording to prevent the inkjet head from being supplied with ink with mingled air, with high accuracies even in use of low temperatures of ink.

To achieve the object described, according to the present invention, there is an inkjet printer comprising an ink tank configured with an ink layer and an air layer, an inkjet head configured for ink discharge actions using ink supplied from the ink tank, an ink circulation route configured for circulation of ink between the inkjet head and the ink tank, and a flow rate difference reducer configured to work when a viscosity of upstream ink being returned from the inkjet head to the ink tank is higher than a viscosity of downstream ink being supplied from the ink tank to the inkjet head, to reduce a flow rate difference developed between upstream ink and downstream ink with a viscosity difference between upstream ink and downstream ink.

DETAILED DESCRIPTION OF EMBODIMENTS

There will be described embodiments of the present invention with reference to the drawings.

First Embodiment

Figure 1:
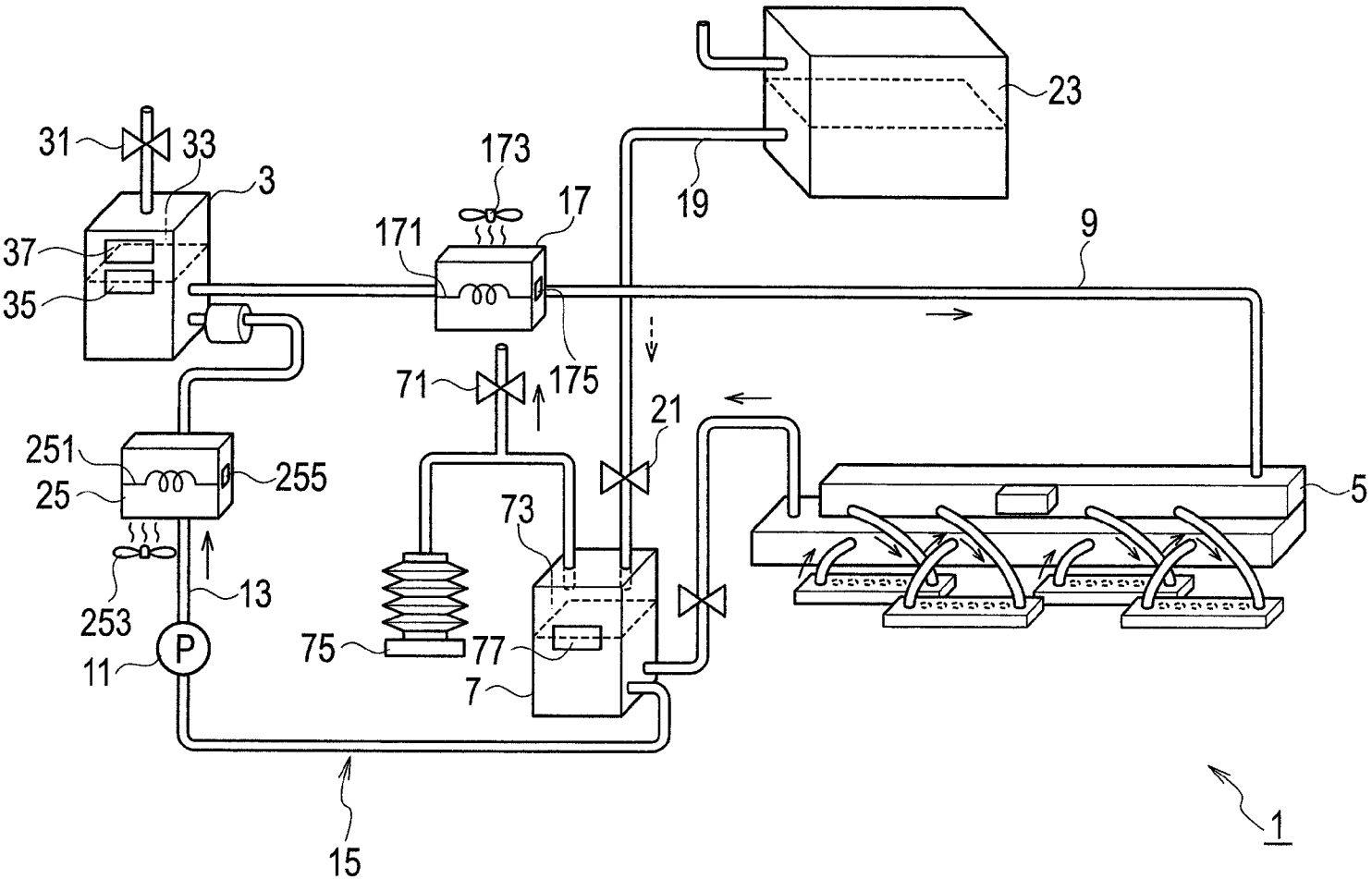
FIG. 1 is an illustration describing an entire configuration for each of inkjet printers according to a first or a second embodiment of the present invention.

FIG. 1 illustrates an entire configuration of an inkjet printer according to a first embodiment of the present invention.

According to this embodiment, there is an inkjet printer 1 adapted for print services using aqueous ink. It has an ink circulation route 15 composed of an ink line 9 extending from an upper ink tank 3, through an inkjet head 5, to a lower ink tank 7, and an ink line 13 extending from the lower tank 7, through an ink circulation pump 11, to the upper tank 3.

The upper tank 3 has therein an air layer 33 communicating with the atmosphere through a pipe provided with an air release valve 31. The air layer 33 serves as a buffer acting against pulsation due to pressures of ink pumped by the circulation pump 11 for circulation along the ink circulation route 15, or to exert stabilized ink pressures on ink meniscus at nozzles in the inkjet head 5. The upper tank 3 is provided with a pair of liquid level sensors 35 and 37 configured (as an upper threshold value detector and a limit value detector respectively) to detect the level of liquid surface of ink in the tank 3, checking for an upper threshold value of the ink level, and a limit value specified thereover as a still higher value.

The ink line 9 has a temperature controller 17 installed thereon (as a downstream heater). The temperature controller 17 is configured to control temperatures of ink (as downstream ink) being supplied from the upper tank 3 to the inkjet head 5, to adjust to be adequate for the inkjet head 5 to propel out droplets of ink by adequate discharge speeds. For this sake, the temperature controller 17 is provided with a heater 171 for heating services, a fan 173 combined with a heat sink for cooling services, and a temperature sensor 175 for detecting an ink temperature of ink passing through the ink line 9.

The inkjet head 5 is composed of a set of blocks each provided with nozzles, and disposed in position lower than the upper tank 3. At the inkjet head 5, each nozzle is supplied with ink from the upper tank 3, through the ink line 9, with a pressure corresponding to a difference in water head between a liquid level of ink in the upper tank 3 and a meniscus of ink at the nozzle.

The lower tank 7 is disposed in position lower than the inkjet head 5, and configured to receive an excess of ink collected by own weight from the inkjet head 5. The lower tank 7 has therein an air layer 73 communicating with the atmosphere through a pipe provided with an air release valve 71. The air layer 73 serves while circulation of ink is stopped, for use of atmospheric pressure to stabilize ink pressures acting on ink meniscus at nozzles in the inkjet head 5. The lower tank 7 is provided with a pressure controller 75 connected thereto as a regulator composed of a bellows for instance, through a bifurcate branch of the pipe provided with the air release valve 71, and adapted to exert a negative pressure as necessary on the air layer 73 of the lower tank 7.

Further, the lower tank 7 is provided with a liquid level sensor 77 configured to detect the level of liquid surface of ink in the lower tank 7, checking for a lower threshold value of the ink level. In addition, the lower tank 7 has a replenishing ink tank 23 connected thereto through a replenishing ink line 19 provided with an open-close valve 12. With the level of liquid surface of ink in the lower tank 7 detected by the liquid level sensor 77 as being lowered to the lower threshold value, the open-close valve 12 is operated to open, as necessary, to supply the lower tank 7 with ink replenished from the replenishing ink tank 23 through the replenishing ink line 19 to an adequate degree.

The circulation pump 11 serves (as a main pump) to return ink from the lower tank 7 through the ink line 13 to the upper tank 3. The ink line 13 has a temperature controller 25 installed thereon (as an upstream heater). The temperature controller 25 is configured to control temperatures of ink (as upstream ink) being returned from the lower tank 7 through the circulation pump 11 to the upper tank 3, to be adequate for the inkjet head 5 to propel out droplets of ink by adequate discharge speeds. For this sake, the temperature controller 25 is provided with a heater 251 for heating services, a fan 253 combined with a heat sink for cooling services, and a temperature sensor 255 for detecting an ink temperature of ink passing through the ink line 13.

According to this embodiment, the inkjet printer 1 is adapted to work while waiting for a print job, to interrupt circulation of ink in the ink circulation route 15, and work for any accepted print job, to enter a warm-up mode or print mode, restarting circulation of ink in the ink circulation route 15. During such or associated operations, there are control actions made to operate the air release valve 31 at the upper tank 3 and the air release valve 71 at the lower tank 7 to open and close, while operating the pressure controller 75, as necessary to exert adequate negative pressures on meniscus of ink in the inkjet head 5.

At the inkjet printer 1, if the state waiting for a print job is continued for a long interval, residual ink in the ink circulation route 15 has temperatures decreased lower than an adequate temperature range. To this point, after reception of a current print job, the inkjet printer 1 works when restarting circulation of ink in the ink circulation route 15, to check those temperatures of ink detected by, among others, the temperature sensors 175 and 255 at the temperature controllers 17 and 25, respectively, to determine whether they are retained within the adequate temperature range. Unless they are so, the inkjet printer 1 enters a warm-up mode. In the warm-up mode, the air release valve 31 at the upper tank 3 is closed, so the air layer 33 in the upper tank 3 is cut off from the atmosphere. Therefore, in the warm-up mode, as ink is supplied from the upper tank 3 to the inkjet head 5, the upper tank 3 would have a commensurate negative pressure exerted on the air layer 33, damping the supply of ink from the upper tank 3 to the inkjet head 5, unless the upper tank 3 is supplied with an equivalent or greater amount of ink from the lower tank 7. In consideration of this mechanism, the inkjet printer 1 may well be adapted to work in the warm-up mode, to lower the rate of decrease in quantity of ink in the upper tank 3, or increase the flow rate of ink being supplied from the lower tank 7 to the upper tank 3 to raise the rate of increase in quantity of ink supplied to the upper tank 3, affording to suppress mingling air from the air layer 33 into ink being supplied to the inlet head 5.

Further, during the warm-up mode, the heaters 171 and 251 at the temperature controllers 17 and 25 are controlled for heating ink circulating in the ink circulation route 15 as necessary to warm up to the adequate temperature range. After the warm-up of ink to the adequate temperature range, the inkjet printer 1 interrupts the warm-up mode, to enter a print mode to propel out droplets of ink from the inkjet head 5, through nozzles, to make a print according to the current print job.

Figure 2A:
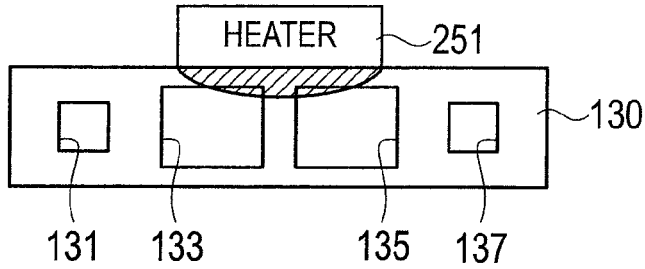
FIGS. 2A and 2B are illustrations each describing configurations of, and positional relationships between, a heater of a corresponding temperature controller and an array of ink flow paths associated therewith in an inkjet printer according to the first embodiment.
Figure 2B:
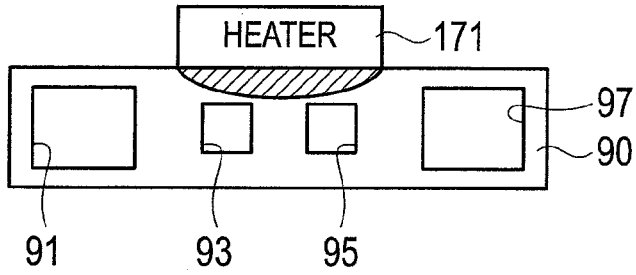

Description is now made of respective configurations of, and positional relationships between, flow paths in the ink lines 9 and 13 and heaters at the temperature controllers 17 and 25 installed thereon, with reference to illustrations in FIGS. 2A and 2B. FIG. 2A is an illustration describing an example of configuration of, and an example of positional relationship between, an array of flow paths in the ink line 13 and the heater 251 at the temperature controller 25, which are installed upstream of the upper tank 3 in the direction of circulation of ink in the ink circulation route 15. FIG. 2B is an illustration describing an example of configuration of, and an example of positional relationship between, an array of flow paths in the ink line 9 and the heater 171 at the temperature controller 17, which are installed downstream of the upper tank 3 in the direction of circulation of ink in the ink circulation route 15.

As illustrated in FIG. 2A, the ink line 13 includes an upstream flow path block 130 that has an array of four flow paths 131, 133, 135, and 137 formed therein (as upstream flow paths). The upstream flow path block 130 is provided with the heater 251 of temperature controller 25 fixed to a lateral side thereof. In the upstream flow path block 130, the flow path array has two central flow paths 133 and 135 (as upstream large flow paths) located at a close distance from the heater 251, and two peripheral or near-end flow paths 131 and 137 (as upstream small flow paths) formed with a smaller flow path sectional area, and located at a further distance from the heater 251, in comparison with the flow paths 133 and 135.

On the other hand, as illustrated in FIG. 2B, the ink line 9 includes a downstream flow path block 90 that has an array of four flow paths 91, 93, 95, and 97 formed therein (as downstream flow paths). The downstream flow path block 90 is provided with the heater 171 of temperature controller 17 fixed to a lateral side thereof. In the downstream flow path block 90, the flow path array has two central flow paths 93 and 95 (as downstream small flow paths) located at a close distance from the heater 171, and two peripheral or near-end flow paths 91 and 97 (as downstream large flow paths) formed with a larger flow path sectional area, and located at a further distance from the heater 171, in comparison with the flow paths 93 and 95.

It is noted that the central flow paths 93 and 95 in the downstream flow path block 90 have the same flow path sectional area as the flow path sectional area of the near-end flow paths 131 and 137 in the upstream flow path block 130, and that the near-end flow paths 91 and 97 in the downstream flow path block 90 have the same flow path sectional area as the flow path sectional area of the central flow paths 133 and 135 in the upstream flow path block 130. The upstream flow path block 130 and the downstream flow path block 90 are thus configured to have an equalized total flow path sectional area. Accordingly, the array of flow paths 131, 133, 135, and 137 in the upstream flow path block 130 has such a total flow rate of ink passing therethough as equalized to a total flow rate of ink passing through the array of flow paths 91, 93, 95, and 97 in the downstream flow path block 90, subject to no difference between a substantial viscosity of ink passing through the array of flow paths 131, 133, 135, and 137 and a substantial viscosity of ink passing through the array of flow paths 91, 93, 95, and 97.

Such being the case, according to this embodiment, the inkjet printer 1 is adapted to heat ink in the ink line 9 and ink in the ink line 13, by use of the heater 171 at the temperature controller 17 and the heater 251 at the temperature controller 25, which are configured for an equalized dissipation of thermal energy. It is noted that this embodiment includes a flow rate difference reducer comprised of the downstream flow path block 90, the upstream flow path block 130, and the heaters 171 and 251 at the temperature controllers 17 and 25.

At the upstream flow path block 130 illustrated in FIG. 2A, the central combination of flow paths 133 and 135 larger in flow path sectional area has a higher efficiency in transfer of heat from the heater 251, than the peripheral combination of flow paths 131 and 137 smaller in flow path sectional area. The upstream flow path block 130 is thus configured to work when using the heater 251 at the temperature controller 25 for heating ink, to have those streams of ink passing through the flow paths 133 and 135 larger in flow path sectional area, heated with higher efficiencies and faster temperature-risen to lower viscosities, with faster reduced fluid resistances to pass through the flow paths 133 and 135, than those streams of ink passing through the flow paths 131 and 137 smaller in flow path sectional area.

On the other hand, at the downstream flow path block 90 illustrated in FIG. 2B, the central combination of flow paths 93 and 95 smaller in flow path sectional area has a higher efficiency in transfer of heat from the heater 171 put on a central region of a lateral side of the downstream flow path block 90, than the peripheral combination of flow paths 91 and 97 larger in flow path sectional area. The downstream flow path block 90 is thus configured to work when using the heater 171 at the temperature controller 17 for heating ink, to have those streams of ink passing through the flow paths 93 and 95 smaller in flow path sectional area, heated with higher efficiencies and faster temperature-risen, with faster lowered viscosities and faster reduced fluid resistances to pass through the flow paths 93 and 95, than those streams of ink passing through the flow paths 91 and 97 larger in flow path sectional area.

The upstream flow path block 130 is thus adapted to implement a prevailing heating for streams of ink passing through the flow paths 133 and 135 larger in flow path sectional area and wall area contacting with ink, while the downstream flow path block 90 is adapted to implement a prevailing heating for streams of ink passing through the flow paths 93 and 95 smaller in flow path sectional area and wall area contacting with ink. In this respect, the heater 171 at the temperature controller 17 is configured to work for a dissipation of thermal energy equivalent to a concurrent dissipation of thermal energy by the heater 251 at the temperature controller 25, so the upstream flow path block 130 is adapted to have a total flow of ink passing through the flow paths 131, 133, 135, and 137 heated faster, with faster lowered viscosities, than a total flow of ink passing through the flow paths 91, 93, 95, and 97 at the downstream flow path block 90. Accordingly, relative to the flow rate of ink passing through the flow paths 91, 93, 95, and 97 at the downstream flow path block 90, the flow rate of ink passing through the flow paths 131, 133, 135, and 137 at the upstream flow path block 130 is kept greater, until circulating ink in the ink circulation route 15 is wholly heated to have temperatures within an adequate temperature range.

Therefore, the upper tank 3 is adapted to have a greater flow of ink supplied thereto from the lower tank 7, than a flow of ink supplied therefrom to the inkjet head 5, until ink is warmed up to adequate temperatures over length of the ink circulation route 15. During the warm-up mode, the upper tank 3 is thus kept from undergoing decreased ink levels with a potential commingling of air of the air layer 33 with streams of ink being supplied to the inkjet head 5.

According to the first embodiment configured as described, the inkjet printer 1 is adapted to cope with a situation of the ink circulation route 15 having ink temperatures decreased lower than an adequate temperature range, by heating ink with the heaters 171 and 251, affording to keep the flow rate of ink being supplied from the lower tank 7 to the upper tank 3 greater than the flow rate of ink being supplied from the upper tank 3 to the inkjet head 5.

It therefore is possible to prevent the inkjet head 5 from being supplied with ink from the upper tank 3 with bubbles of mingled air, even in situations of ink being supplied from the lower tank 7 to the upper tank 3, with lower temperatures and higher viscosities than ink being supplied from the upper tank 3 to the inkjet head 5.

Further, provision of the combination of downstream flow path block 90 and upstream flow path block 130 configured as described enables setting different heating efficiencies for streams of ink passing through the flow paths 91, 93, 95, and 97 and streams of ink passing through the flow paths 131, 133, 135, and 137, to render among others their temperature raising speeds as well as viscosity lowering speeds different from each other, without using materials with different heat-transfer coefficients to implement such configuration.

Figure 3:
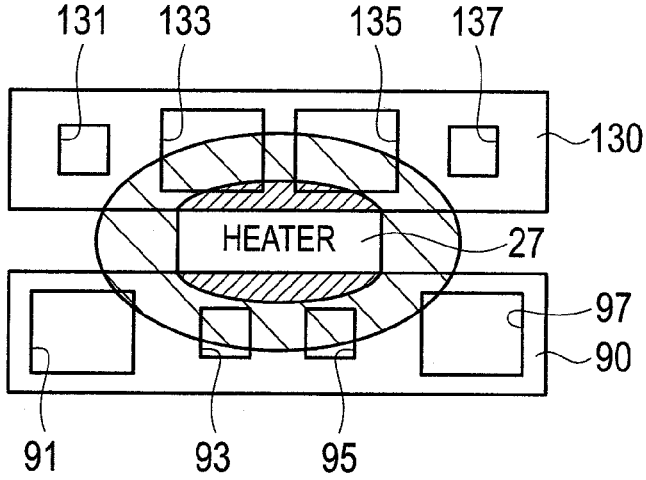
FIG. 3 is an illustration describing configurations of, and positional relationships between, a heater of a temperature controller and arrays of ink flow paths associated therewith in an inkjet printer according to a first modification of the first embodiment.

It is noted that in the first embodiment, the heater 171 fixed to the downstream flow path block 90 for heating ink in the ink line 9 is separated from the heater 251 fixed to the upstream flow path block 130 for heating ink in the ink line 13, to implement their individual installation. However, as shown in FIG. 3 illustrating a first modification of the first embodiment, there may be use of combination of a downstream flow path block 90 and an upstream flow path block 130 disposed in parallel to each other, with a common heater 27 mounted on and between central regions of opposite lateral sides of the blocks 90 and 130. With this configuration also, there can be obtained similar effects to the inkjet printer 1 according to the first embodiment. Moreover, there can be common use of the heater 27 between the downstream flow path block 90 and the upstream flow path block 130 allowing for, among others, a saved space for installation of heater 27 as well as an inkjet printer 1 down-scaled in its entirety.

It also is noted that in the first embodiment, the downstream flow path block 90 and the upstream flow path block 130 each respectively have two kinds flow paths 91, 97 and 93, 95 or 131, 137 and 133, 135 formed therethrough with different flow path sectional areas. However, as shown in FIG. 4 illustrating a second modification of the first embodiment, there may be use of combination of a downstream flow path block 90 and an upstream flow path block 130 each respectively having an array of flow paths 91*a*, 93*a*, 95*a*, and 97*a* or flow paths 131*a*, 133*a*, 135*a*, and 137*a* formed therethrough with an identical flow path sectional area.

In this configuration, the downstream and upstream flow path blocks 90 and 130 may well have the arrays of flow paths 91*a*, 93*a*, 95*a*, and 97*a* and flow paths 131*a*, 133*a*, 135*a*, and 137*a* both offset in a sense to dispose near corresponding lateral sides thereof, respectively, with a common heater 27 mounted on and between a central region of a lateral side of the downstream flow path block 90 positioned off from the array of flow paths 91*a*, 93*a*, 95*a*, and 97*a* and a central region of a lateral side of the upstream flow path block 130 positioned close to the array of flow paths 131*a*, 133*a*, 135*a*, and 137*a*.

Such the configuration permits the transfer of heat from the heater 27 to be more efficient at a respective one of flow paths 131*a*, 133*a*, 135*a*, and 137*a* in the upstream flow path block 130 that are relatively near to the heater 27, than at a corresponding one of flow paths 91*a*, 93*a*, 95*a*, and 97*a* in the downstream flow path block 90 that are relatively distant from the heater 27. Accordingly, there can be obtained similar effects to an inkjet printer 1 according to the first modification of the first embodiment.

Figure 4:
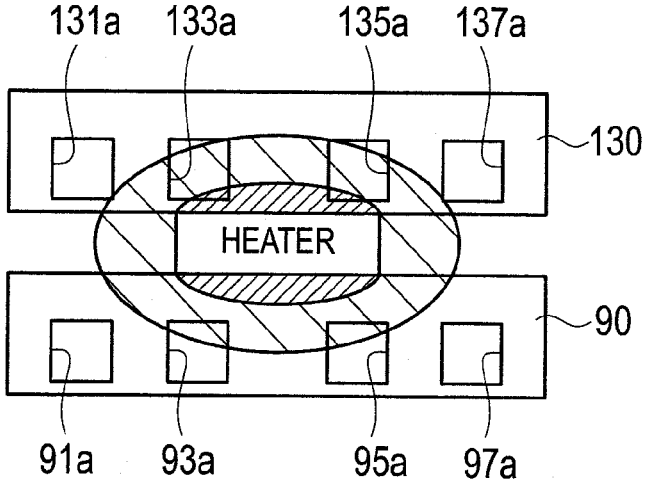
FIG. 4 is an illustration describing configurations of, and positional relationships between, a heater of a temperature controller and arrays of ink flow paths associated therewith in an inkjet printer according to a second modification of the first embodiment.

The configuration illustrated in FIG. 4 may well be modified in part complying with the first embodiment, to have individual heaters 171 and 251 fixed on corresponding lateral sides of downstream and upstream flow path blocks 90 and 130, respectively. In this modification also, there can be obtained similar effects to the inkjet printer 1 according to the first embodiment.

In addition, it is noted that in any of the first embodiment and the first and the second modification thereof, there is use of combination of a downstream flow path block 90 and an upstream flow path block 130 each respectively having an array of flow paths 91*a*, 93*a*, 95*a*, and 97*a* or flow paths 131*a*, 133*a*, 135*a*, and 137*a* formed therethrough. However, as another modification of the example shown in FIG. 4, there may be use of combination of a downstream flow path block 90 having an array of flow paths 91*a*, 93*a*, 95*a*, and 97*a* interconnected with each other to make a single flow path, and an upstream flow path block 130 having an array of flow paths 131*a*, 133*a*, 135*a*, and 137*a* interconnected with each other to make a single flow path, providing that this single flow path has the same sectional area as that single flow path. This configuration also permits the transfer of heat from a heater 27 to be more efficient at a respective one of interconnected flow paths in the upstream flow path block 130 that are relatively near to the heater 27, than at a corresponding one of interconnected flow paths in the downstream flow path block 90 that are relatively distant from the heater 27. Accordingly, there can be obtained similar effects to an inkjet printer 1 according to the second modification of the first embodiment that includes the combination of downstream flow path block 90 and upstream flow path block 130 illustrated in FIG. 4.

Second Embodiment

Description is now made of an inkjet printer according to a second embodiment of the present invention. According to this embodiment, there is an inkjet printer 1 different from the inkjet printer 1 according to the first embodiment in that the former has, among others, an ink line 9 excluding the downstream flow path block 90, and an ink line 13 excluding the upstream flow path block 130, subject to provision of temperature controllers 17 and 25 including heaters 171 and 251 configured to output different amounts of thermal energy.

According to this embodiment, the inkjet printer 1 is configured to work during a warm-up mode, to output a greater amount of thermal energy at the heater 251 than at the heater 171. This arrangement permits a flow of ink passing through the ink line 13 to be heated with a greater amount of thermal energy and faster temperature-risen, with faster lowered viscosities and faster reduced fluid resistances to pass through the ink line 13, than a flow of ink passing through the ink line 9.

Accordingly, there is adaptation implemented to have a greater flow of ink supplied from a lower tank 7 to an upper tank 3, than a flow of ink supplied from the upper tank 3 to an inkjet head 5, until ink is warmed up to adequate temperatures over length of an ink circulation route 15. During the warm-up mode, the upper tank 3 is thus kept from undergoing decreased ink levels with a potential commingling of air of an air layer 33 with streams of ink being supplied to the inkjet head 5.

Also for the inkjet printer 1 according to the second embodiment configured as described, it is possible to obtain similar effects to the inkjet printer 1 according to the first embodiment.

According to the second embodiment, the inkjet printer 1 is configured to work after acceptance of an input print job followed by transition from a waiting mode to the warm-up mode for heating a state of ink having temperatures lower than an adequate temperature range, to operate the heater 251 to output a greater amount of thermal energy than the heater 171, to provide a greater amount of thermal energy for heating a flow of ink passing through the ink line 13 than an amount of thermal energy used for heating a flow of ink passing through the ink line 9.

To this point, there may be a configuration to work upon transition from the waiting mode to the warm-up mode, to take measures of temperatures of ink in the ink lines 9 and 13, and operate simply for a lower measure of ink temperature taken on the ink line 13 extending upstream of the upper tank 3, to drive the heater 251 to output a greater amount of thermal energy than the heater 171, to provide a greater amount of thermal energy for heating a flow of ink passing through the ink line 13 than an amount of thermal energy used for heating a flow of ink passing through the ink line 9.

In this regard, according to a third embodiment of the present invention, there is an inkjet printer 1 configured like that, which will be described with reference to FIG. 5 and FIG. 6.

Third Embodiment

Figure 5:
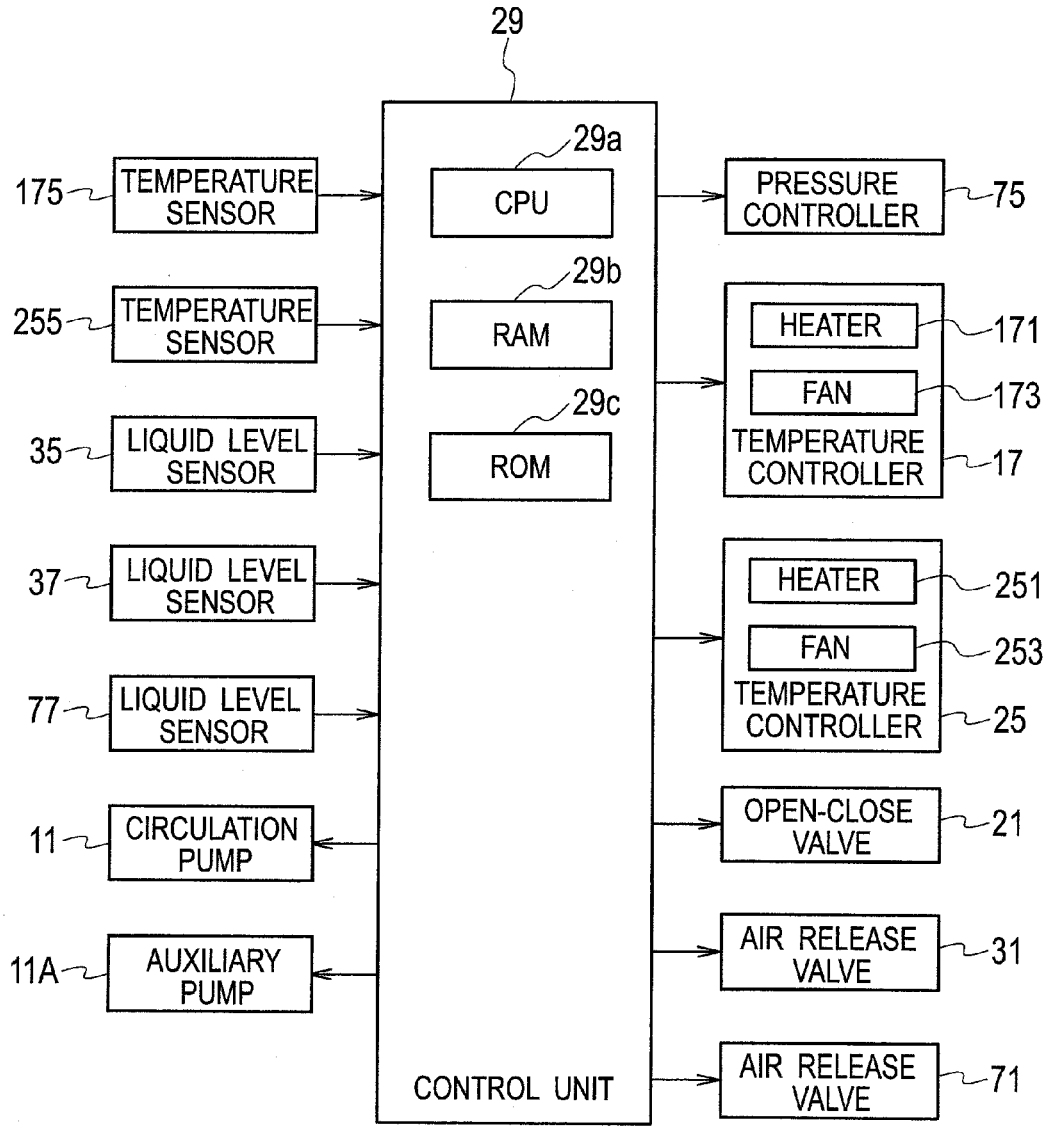
FIG. 5 is a block diagram showing an electrical configuration for each of inkjet printers according to a third or a fourth embodiment of the present invention.

FIG. 5 is a block diagram showing an electrical configuration of inkjet printer according to the third embodiment of the present invention. According to this embodiment, the inkjet printer 1 has a control unit 29 for entire system control. The control unit 29 includes a CPU 29*a* adapted for use of working areas in a RAM 29*b* to execute programs stored in a ROM 29*c*, to implement a variety of control processes.

The control unit 29 is connected with respective temperature sensors 175 and 255 for temperature controllers 17 and 25, respective liquid level sensors 35, 37, and 77 and air release valves 31 and 77 for an upper tank 3 and a lower tank 7, and respective heaters 171 and 251 and fans 173 and 253 at the temperature controllers 17 and 25, as well as with a pressure controller 75, a circulation pump 11, and an open-close valve 21. It is noted that FIG. 5 shows an auxiliary pump 11A, which is a component element of an inkjet printer 1 according to a later-described fourth embodiment of the present invention, and excluded from the inkjet printer 1 according to the present embodiment.

Figure 6:
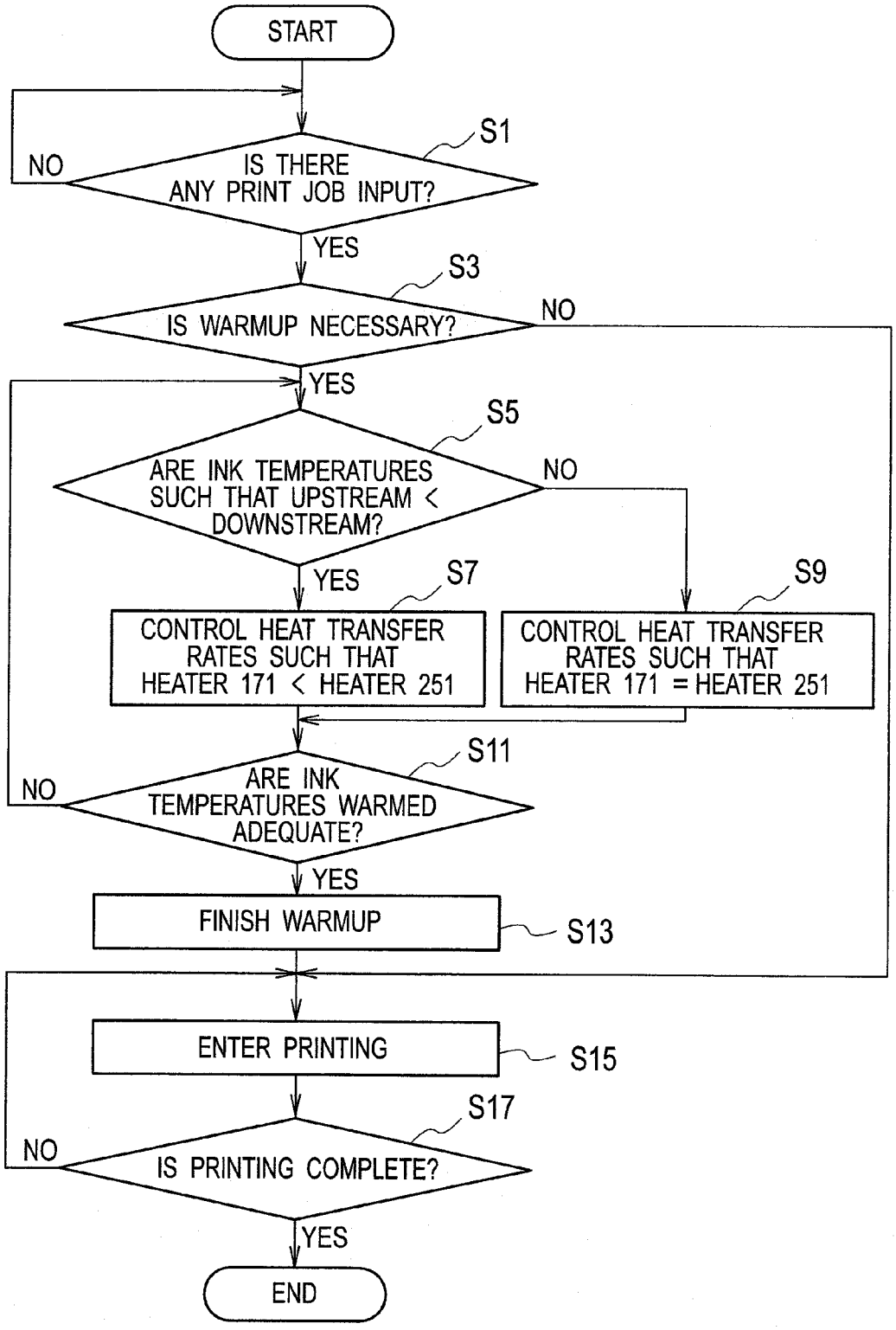
FIG. 6 is a flowchart roughly showing processes associated with a warm-up mode at a control unit in an inkjet printer according to the third embodiment.

Description is now made of an outline of processes associated with a warm-up mode to be executed at the CPU 29*a* in the control unit 29, with reference to a flowchart in FIG. 6. Initially, the CPU 29*a* waits for a print job input thereto, by repeating a step S1 of checking for an input print job (as the result is NO). If there is any print job input (YES at the step S1), the control flow goes to a step S3 to check for a need of warm-up. This check is made on the basis of data on measures at the temperature sensors 175 and 255 for the temperature controllers 17 and 25, to determine whether or not measured temperatures of ink in an ink circulation route 15 are lower than an adequate temperature range.

If there is no need of warm-up (NO at the step S3), the control flow goes to a later-described step S15. If there is any need of warm-up (YES at the step S3), the control flow goes to a step S5 for operating on the basis of data on measures at the temperature sensors 175 and 255, to determine whether or not a measured temperature of ink in an ink line 13 (that extends upstream of the upper tank 3 in the direction of circulation of ink in the ink circulation route 15) is lower than a measured temperature of ink in an ink line 9 (that extends downstream of the upper tank 3).

If the measured temperature of ink in the ink line 13 is lower than the measured temperature of ink in the ink line 9 (YES at the step S5), the control flow goes to a step S7 for driving the heater 251 at the temperature controller 25 on the ink line 13 to output a greater amount of thermal energy than the heater 171 at the temperature controller 17 on the ink line 9. On the other hand, if the measured temperature of ink in the ink line 13 is not lower than the measured temperature of ink in the ink line 9 (NO at the step S5), the control flow goes to a step S9 for driving the heater 251 at the temperature controller 25 on the ink line 13 to output the same amount of thermal energy as the heater 171 at the temperature controller 17 on the ink line 9.

Next, at a step S11, the CPU 29*a* operates on the basis of data on measures at the temperature sensors 175 and 255 for the temperature controllers 17 and 25, to determine whether or not measured temperatures of ink in the ink circulation route 15 are raised up to the adequate temperature range. If they are not raised up to the adequate temperature range (NO at the step S11), the control flow again goes to the step S5. If they are raised up to the adequate temperature range (YES at the step S11), the control flow goes to a step S13 for finishing the warm-up, before going to the step S15 to enter a print mode. Then, at a step S17, the CPU 29*a* checks if the printing is complete. If it is so (YES at the step S17), the control flow goes to an end.

It is noted that the third embodiment involves the steps S3 to S7 in the flowchart of FIG. 6, as a processing corresponding to a flow rate difference reducer.

According to the preset embodiment, the inkjet printer 1 is adapted to cope with a situation of the ink circulation route 15 having ink temperatures decreased lower than an adequate temperature range, by executing the warm-up mode of heating ink with the heaters 171 and 251, affording to operate if a measured temperature of ink in the ink line 13 is lower than a measured temperature of ink in the ink line 9, for use of the heater 251 to heat ink in the ink line 13 with a greater amount of thermal energy, thereby permitting any flow rate of ink being supplied from the lower tank 7 to the upper tank 3 to be kept greater than a flow rate of ink being supplied from the upper tank 3 to an inkjet head 5.

It therefore is possible to prevent the inkjet head 5 from being supplied with ink from the upper tank 3 with bubbles of mingled air, even in situations of ink being supplied from the lower tank 7 to the upper tank 3, with lower temperatures and higher viscosities than ink being supplied from the upper tank 3 to the inkjet head 5.

Such being the case, according to the third embodiment, the inkjet printer 1 is configured to work upon transition from the waiting mode to the warm-up mode, to operate if a measured temperature of ink in the ink line 13 is lower than a measured temperature of ink in the ink line 9, for use of the heater 251 to provide a greater amount of thermal energy for heating ink in the ink line 13 than an amount of thermal energy used for heating ink in the ink line 9, affording to have viscosities of ink in the ink line 13 decreased lower than viscosities of ink in the ink line 9, permitting any flow rate of ink in the ink line 13 to be greater than a flow rate of ink in the ink line 9.

To this point, there may be a configuration for employment of an auxiliary pump to increase the flow rate of ink in the ink line 13, instead of driving the heater 251 to increase the heating rate, faster decreasing viscosities of ink in the ink line 13, to have an increased flow rate of ink in the ink line 13.

In this regard, according to a fourth embodiment of the present invention, there is an inkjet printer 1 configured like that, which will be described with reference to FIG. 5, FIG. 7, and FIG. 8.

Fourth Embodiment

Figure 7:
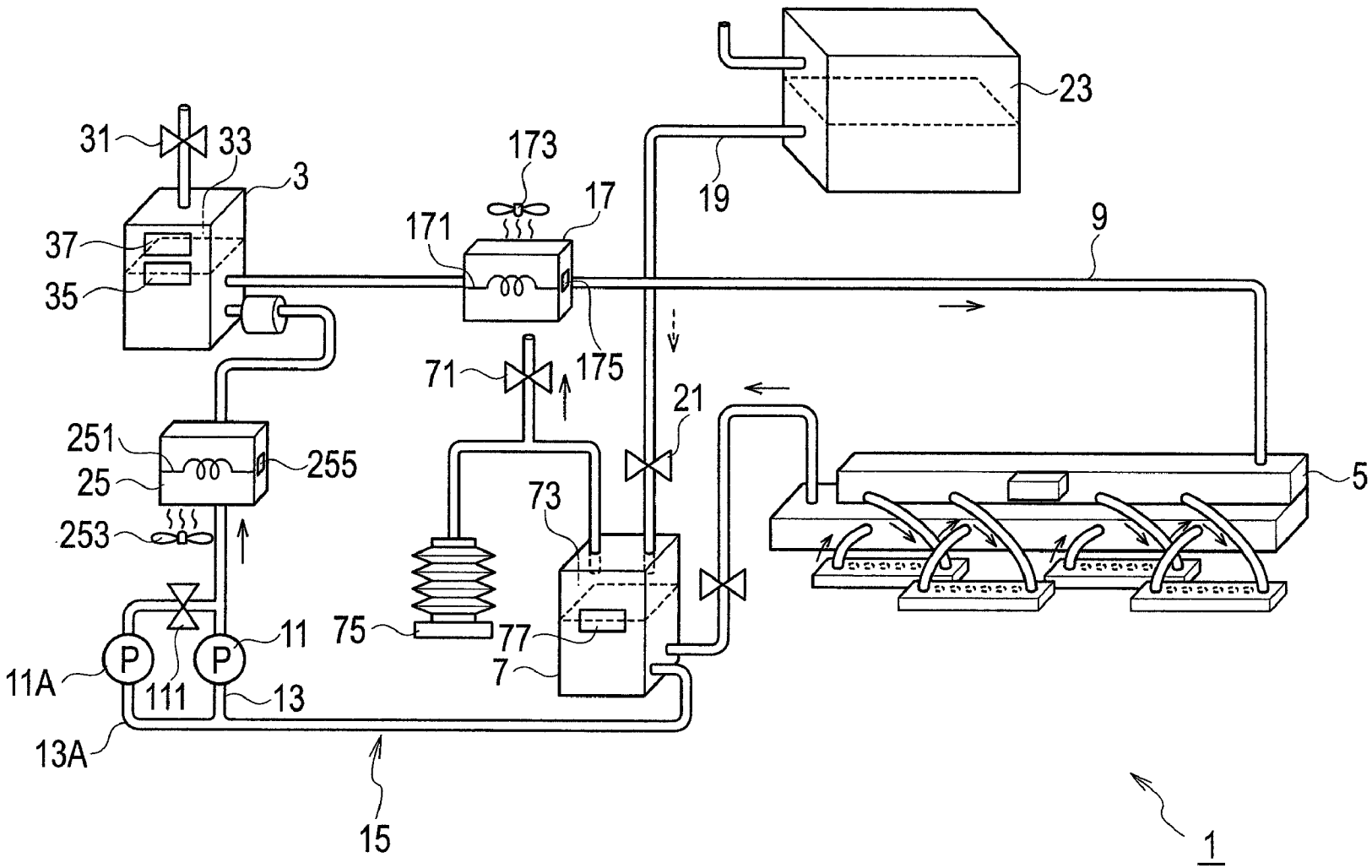
FIG. 7 is an illustration describing an entire configuration of an inkjet printer according to the fourth embodiment.

FIG. 7 is an illustration describing an entire configuration of an inkjet printer according to the fourth embodiment. According to this embodiment, there is an inkjet printer 1 having an auxiliary pump 11A added as a subsidiary pump to the inkjet printer 1 according to the third embodiment. The auxiliary pump 11A is installed on a bypass line 13A of an ink line 13. The bypass line 13A has a check valve 111 installed thereon at a delivery end of the auxiliary pump 11A joined to the ink line 13.

According to this embodiment, the inkjet printer 1 has an electric configuration thereof illustrated in FIG. 5. As shown in FIG. 5, the auxiliary pump 11A is connected with a control unit 29.

Figure 8:
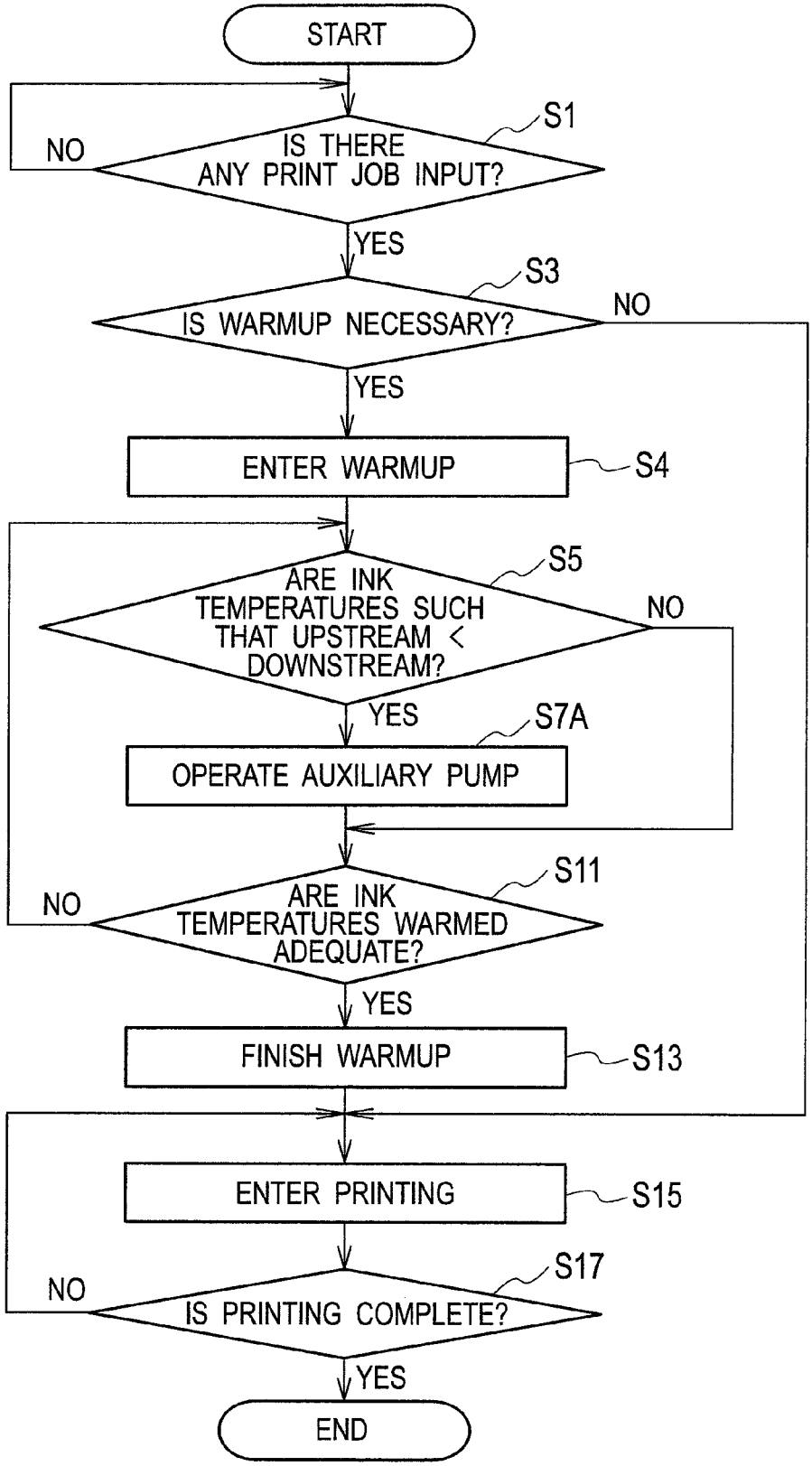
FIG. 8 is a flowchart roughly showing processes associated with a warm-up mode at a control unit in the inkjet printer according to the fourth embodiment.

Description is now made of an outline of processes associated with a warm-up mode to be executed at a CPU 29*a* in the control unit 29, with reference to a flowchart in FIG. 8. According to this embodiment, the CPU 29*a* first implements a step S1 and a subsequent step S3, like the CPU 29*a* according to the third embodiment. If there is any need of warm-up (YES at the step S3), the control flow goes to a step S4 to start a warm-up using heaters 171 and 251 for heating ink in ink lines 9 and 13, while operating a circulation pump 11 for circulation of ink along an ink circulation route 15.

Then, if a measured temperature of ink in the ink line 13 is lower than a measured temperature of ink in the ink line 9 (YES at the step S5), the control flow goes to a step S7A for operating the auxiliary pump 11A, before going to a step S11. On the other hand, if the measured temperature of ink in the ink line 13 is not lower than the measured temperature of ink in the ink line 9 (NO at the step S5), the control flow directly goes to the step S11. It is noted that there are steps S11 et seq., which are similar to those executed by the CPU 29*a* in the third embodiment.

It also is noted that the fourth embodiment involves the steps S3, S5, and S7A in the flowchart of FIG. 8, as a processing corresponding to a flow rate difference reducer.

According to the preset embodiment also, the inkjet printer 1 is adapted to cope with a situation of the ink circulation route 15 having ink temperatures decreased lower than an adequate temperature range, by executing a warm-up mode of heating ink with the heaters 171 and 251, affording to operate if a measured temperature of ink in the ink line 13 is lower than a measured temperature of ink in the ink line 9, to drive the auxiliary pump 11A installed on the bypass line 13A of the ink line 13, thereby permitting any flow rate of ink being supplied from a lower tank 7 to an upper tank 3 to be kept greater than a flow rate of ink being supplied from the upper tank 3 to an inkjet head 5.

Also for the inkjet printer 1 according to the fourth embodiment configured as described, it is possible to obtain similar effects to the inkjet printer 1 according to the third embodiment.

According to any of the first to the fourth embodiment or any modification of the first embodiment described hitherto, there is an inkjet printer 1 adapted to serve on the basis of data on measures of a liquid level sensor 35 in an upper tank 3, for a monitoring to check whether or not the liquid level of ink in the upper tank 3 is raised up to an upper threshold value, that is, for an overflow preventing monitoring to be periodically checked at a control unit 29. The control unit 29 is adapted to operate for ink levels exceeding the upper threshold value at the upper tank 3, to provide countermeasures such as issuing a warning, or stopping supplying ink to the upper tank 3. Further, the inkjet printer 1 is adapted to serve on the basis of data on measures of a liquid level sensor 77 in a lower tank 7, for a monitoring to check whether or not the liquid level of ink in the lower tank 7 is lowered down to a lower threshold value, that is, for a monitoring of remaining ink quantity, as a check for a need of ink replenishment, to be performed every prescribed sampling period at the control unit 29. The control unit 29 is adapted to operate for ink levels under the lower threshold value at the lower tank 7, to open an open-close valve 21 on a replenishing ink line 19 to replenish the lower tank 7 with ink supplied from a replenishing tank 23.

By the way, according to any embodiment or modification described, there is an inkjet printer 1 working to cause a flow rate of ink being supplied from a lower tank 7 to an upper tank 3 to be greater than a flow rate of ink being supplied from the upper tank 3 to an inkjet head 5, with an attendant tendency to raise the liquid level of ink in the upper tank 3. This tendency may cause the liquid level of ink in the upper tank 3 to temporarily exceed the upper threshold value. If occurrences of such temporary over-rise of ink level exceeding the upper threshold value were caught from time to time by the control unit 29 at a monitoring service, the control unit 29 might have frequently operated to provide countermeasures such as stopping ink supply to the upper tank 3. Such countermeasures would cause the liquid level of ink in the upper tank 3 to be restored to a state lower than the upper threshold value. However, at the time of restoration, if the inkjet printer 1 were still working to cause a flow rate of ink being supplied from the lower tank 7 to the upper tank 3 to be greater than a flow rate of ink being supplied from the upper tank 3 to the inkjet head 5, the liquid level of ink in the upper tank 3 would have been again raised, exceeding the upper threshold value. Like this, if the control unit 29 is put in service for monitoring ink in the upper tank 3 at short intervals, there might be frequent occurrences of alternating situations developed between a certain liquid level of ink in the upper tank 3 exceeding the upper threshold value and a certain liquid level of ink in the upper tank 3 restored under the upper threshold value.

To this point, in order to prevent occurrences of such alternating situations, the inkjet printer 1 may well be adapted to work to cause a flow rate of ink being supplied from the lower tank 7 to the upper tank 3 to be greater than a flow rate of ink being supplied from the upper tank 3 to the inkjet head 5, while having the control unit 29 put in a service for monitoring ink in the upper tank 3 to check whether or not the liquid level has reached the upper threshold value, at intervals of an extended monitoring period longer than a normal monitoring period to be used when the inkjet printer 1 is not working to cause a flow rate of ink being supplied from the lower tank 7 to the upper tank 3 to be greater than a flow rate of ink being supplied from the upper tank 3 to the inkjet head 5.

Further, the control unit 29 may well be put in the service using an extended monitoring period to check whether or not the liquid level of ink in the upper tank 3 has reached the upper threshold value, in parallel with a service for monitoring ink in the upper tank 3 to check whether or not the liquid level has reached a limit value prescribed as a value greater than the upper threshold value.

Figure 9:
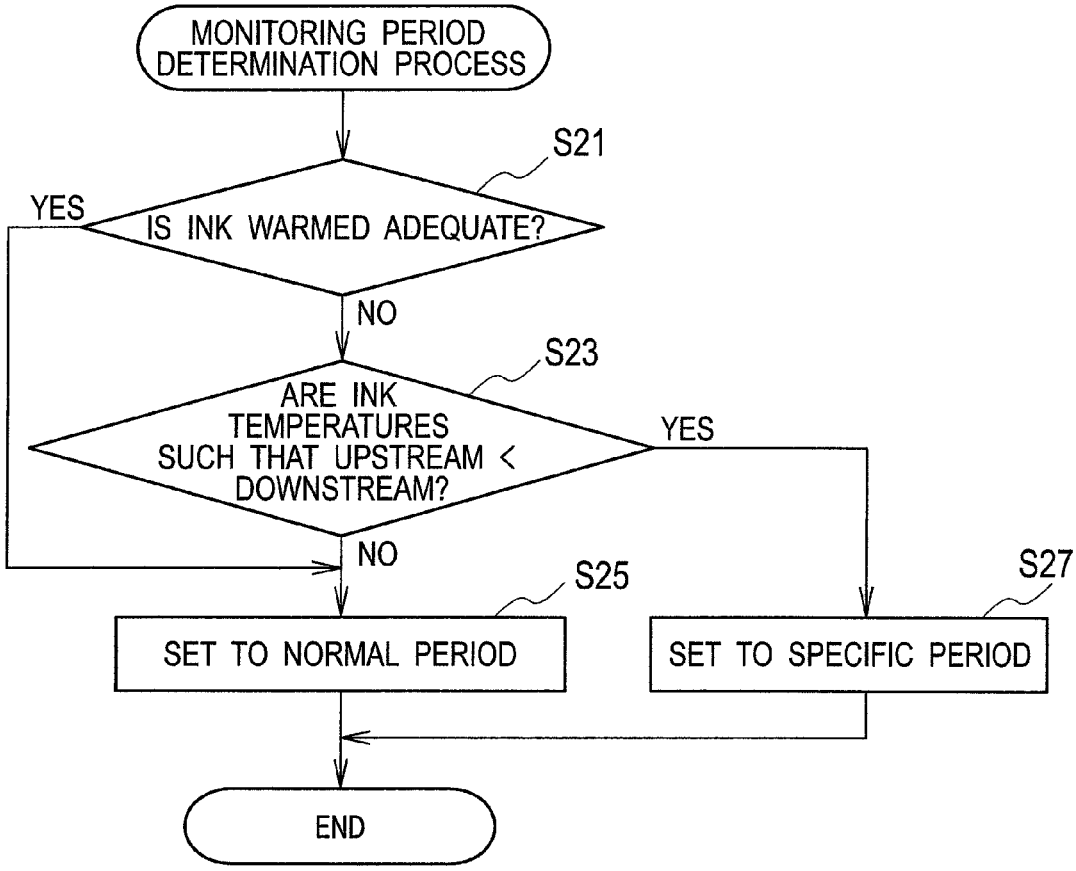
FIG. 9 is a flowchart roughly showing control actions in a process to be implemented for determination on a monitoring period of a liquid level of ink in an upper tank, at a control unit in an inkjet printer according to a fifth embodiment of the present invention.
Figure 10:
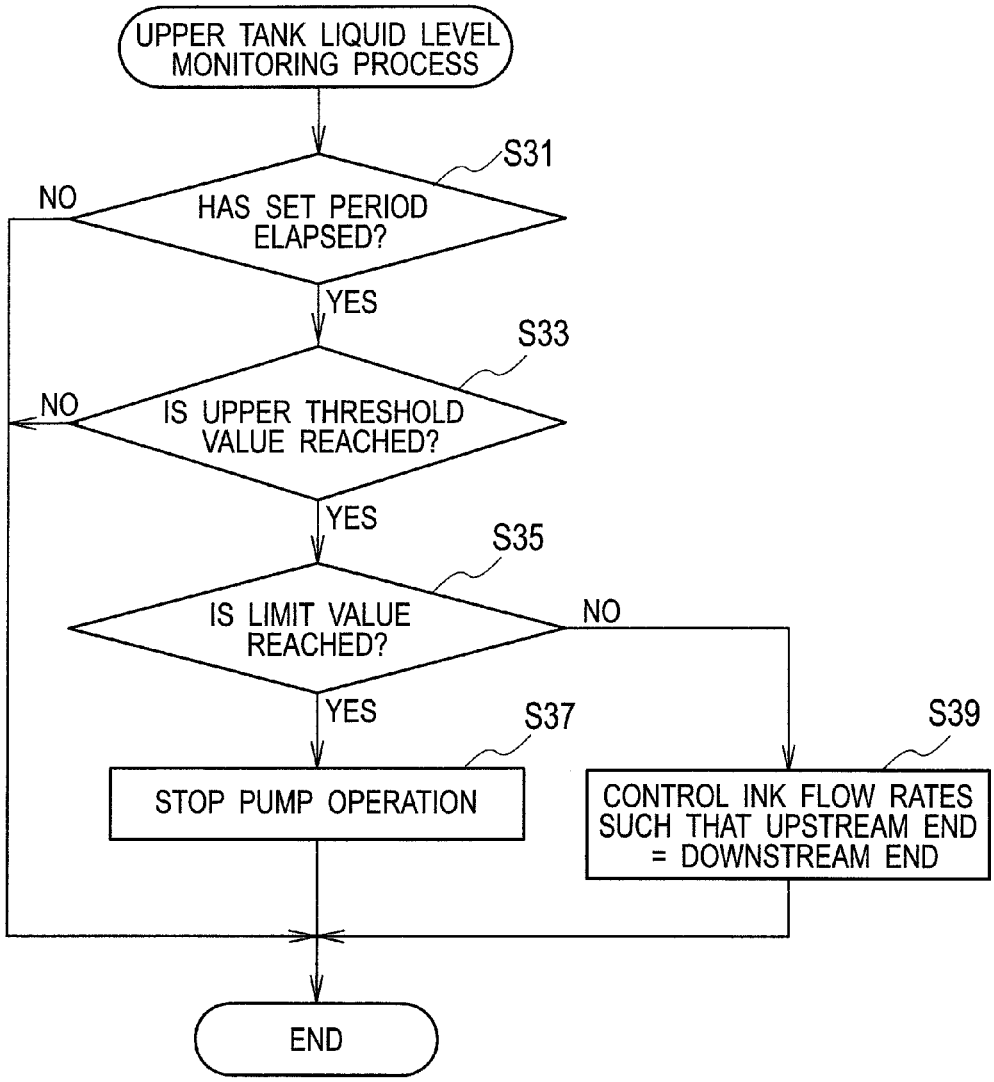
FIG. 10 is a flowchart roughly showing control actions in a process of monitoring a liquid level of ink in the upper tank at the control unit in the inkjet printer according to the fifth embodiment.

In this regard, according to a fifth embodiment of the present invention, there is an inkjet printer 1 configured like that, which will be described with reference to FIG. 9 and FIG. 10. FIG. 9 is a flowchart roughly showing control actions in a process to be implemented for determination on a monitoring period of the liquid level of ink in an upper tank, at a control unit in the inkjet printer according to the fifth embodiment of the present invention. FIG. 10 is a flowchart roughly showing control actions in a process of monitoring the liquid level of ink in the upper tank at the control unit in the inkjet printer according to the fifth embodiment. According to this embodiment, there is a control unit 29 adapted to execute processes shown in FIG. 9 and FIG. 10, as periodical interrupt processes.

It is noted that according to the fifth embodiment, the inkjet printer described is adapted to implement a process of changing the monitoring period, as an example to be additionally executed in an inkjet printer according to the third or the fourth embodiment.

Referring now to FIG. 9, there is a monitoring period determination process in which, at a step S21, a CPU 29*a* operates on the basis of data on measures at temperature sensors 175 and 255, to determine whether or not measured temperatures of ink in an ink circulation route 15 reside within a range of adequate temperatures that permit an inkjet nozzle 5 to propel droplets of ink through nozzles by adequate discharge speeds. If they are adequate temperatures (YES at the step S21), the control flow goes to a step S25.

On the other hand, if they are lower than the adequate temperature range (NO at the step S21), the control flow goes to a step S23 for operating on the basis of data on measures at the temperature sensors 175 and 255, to determine whether or not a measured temperature of ink in an ink line 13 (that extends upstream of an upper tank 3 in the direction of circulation of ink in the ink circulation route 15) is lower than a measured temperature of ink in an ink line 9 (that extends downstream of the upper tank 3).

If the measured temperature of ink in the ink line 13 is not lower than the measured temperature of ink in the ink line 9 (NO at the step S23), the control flow goes to the step S25, where it comes also when measured temperatures of ink in the ink circulation route 15 reside within the adequate temperature range (YES at the step S21). At the step S25, there is a normal period set up as a monitoring period of the liquid level of ink in the upper tank 3. If the measured temperature of ink in the ink line 13 is lower than the measured temperature of ink in the ink line 9 (YES at the step S23), the control flow goes to a step S27, where the monitoring period of liquid level of ink at the upper tank 3 is set to a period (referred herein to as a "specific period") longer than the normal period.

Referring now to FIG. 10, there is an upper tank liquid level monitoring process in which, at a step S31, the CPU 29*a* operates to determine whether or not the period set up (as the normal period or the specific period) at the step S25 or the step S27 in FIG. 9 has elapsed since execution of a previous monitoring. If it has not elapsed yet (NO at the step S31), the upper tank liquid level monitoring process goes to an end. If it has elapsed (YES at the step S31), the control flow goes to a step S33, where the CPU 29*a* operates on the basis of data on a measure at a liquid level sensor 35, to determine whether or not a measured liquid level of ink in the upper tank 3 has reached an upper threshold value.

If it has not reached the upper threshold value (NO at the step S33), the upper tank liquid level monitoring process goes to an end. If it has reached the upper threshold value (YES at the step S33), the control flow goes to a step S35, where the CPU 29*a* operates on the basis of data on a measure at a liquid level sensor 37, to determine whether or not a measured liquid level of ink in the upper tank 3 has reached a limit value. If it has reached the limit value (YES at the step S35), the control flow goes to a step S37, where the CPU 29*a* operates to stop, among others, operations of a circulation pump 11 and an auxiliary pump 11A, to stop circulation of ink in the ink circulation route 15, before the upper tank liquid level monitoring process goes to an end.

If the measured liquid level of ink has not reached the limit value (NO at the step S35), the control flow goes to a step S39, where the CPU 29*a* operates to control heaters 171 and 251 to change their outputs to have a flow rate of ink in the ink line 13 (that extends upstream of the upper tank 3 in the direction of circulation of ink in the ink circulation route 15) equalized to a flow rate of ink in the ink line 9 (that extends downstream of the upper tank 3), or to stop operation of the auxiliary pump 11A, before the upper tank liquid level monitoring process goes to an end.

It is noted that the fifth embodiment involves the steps S21 and S23 in the flowchart of FIG. 9, as a processing corresponding to a flow rate difference reducer. Further, the present embodiment involves combination of the steps S25 and S27 in the flowchart of FIG. 9 and the steps S31 and S33 in the flowchart of FIG. 10, as a processing corresponding to an upper threshold value monitor. In addition, the present embodiment involves the step S35 in the flowchart of FIG. 10, as a processing corresponding to a limit value monitor.

According to the fifth embodiment configured as described, the inkjet printer 1 is adapted for operation to have a flow rate of ink being supplied from a lower tank 7 to the upper tank 3 greater than a flow rate of ink being supplied from the upper tank 3 to the inkjet head 5, affording to prevent situations of the liquid level of ink in the upper tank 3 temporarily exceeding an upper threshold value from being frequently grasped by the control unit 29, by implementation of a process of making the sensitivity dull that corresponds to extension of a monitoring period. Further, the inkjet printer 1 is adapted to work on the basis of data on measures (temperatures of ink) at the temperature sensors 175 and 255 being correlated with viscosities of ink, to determine the monitoring period to be a normal period or a specific period longer than that, thus allowing for an adequate decision of monitoring period to be made as circumstances require.

Further, according to the present embodiment, the inkjet printer 1 is adapted for a concurrent parallel monitoring to check whether or not the liquid level of ink in the upper tank 3 has reached a limit value, thus permitting the control unit 29 to monitor the ink level in course of going to exceed the limit value, before ink overflows, in a quasi state close to such a situation, allowing for provision of adequate countermeasures such as stopping circulation of ink in the ink circulation route 15.

It is noted that the present invention is widely applicable across the board of inkjet printers of an ink circulation system having a tank configured with an internal air layer and disposed in position higher than an inkjet head. Further, the present invention is applicable to a variety of inkjet printers, not simply limiting to those using aqueous ink, but also involving inkjet printers using, among others, liquid ink such as emulsion ink and solvent ink. In addition, the present invention is applicable to both of color printer and black-and-white printer of an inkjet system, as well.

As will be seen from the foregoing description, according to certain embodiments of the present invention, there can be use of a flow rate difference reducer configured to work under those situations in which streams of upstream ink being supplied from an ink circulation route to an ink tank have viscosities higher than viscosities of streams of downstream ink being supplied from the ink tank to an inkjet head, to reduce differences in flow rate between upstream ink and downstream ink, thereby preventing deficiencies in amount of residual ink in the ink tank or attendant commingling of air into downstream ink, or such, with high accuracies, even under low ink temperatures.

On the other hand, as the flow rate difference reducer operates to reduce differences in flow rate between upstream ink and downstream ink, there is a retained tendency to increase the amount of residual ink in the upper tank 3. Therefore, in the course of dissolving viscosity differences between upstream ink and downstream ink, there are probable occurrences of liquid level of ink in the ink tank temporarily exceeding the upper threshold value.

To this point, according to certain embodiments of the present invention, there is an upper threshold value monitor configured to work while the flow rate difference reducer is operating to reduce differences in flow rate between upstream ink and downstream ink, to make a monitoring based on a result of detection by an upper threshold value detector, at intervals of a period longer than a normal period to be used when the flow rate difference reducer is not operating to reduce differences in flow rate of ink. Therefore, after arrival of a monitoring period at the upper threshold value monitor, even if the liquid level of ink in the ink tank has exceeded the upper threshold value for a temporary time, there is still left an interval before arrival of a subsequent monitoring period, affording to have differences in viscosity between upstream ink and downstream ink dissolved to a status in which the flow rate difference reducer is kept from operating to reduce differences in flow rate of ink, thus allowing for an enhanced possibility for the liquid level of ink to return under the upper threshold value.

It therefore is effective for the upper threshold value monitor to have a reduced sensitivity to monitor the liquid level of ink in the ink tank reaching the upper threshold value, to prevent the upper threshold value monitor from getting hyperactive to situations of the liquid level of ink in the ink tank temporarily reaching the upper threshold value, but not continuously exceeding.

Further, according to certain embodiments of the present invention, for determination of a normal period or a specific period whichever is to be set up as a monitoring period of the upper threshold value monitor, there is a decision based on a difference in ink temperature between upstream ink and downstream ink detected at associated temperature detectors, as they are correlated with viscosities of upstream ink and downstream ink. It therefore is possible to employ ink temperatures of upstream ink and downstream ink or differences in between as indices, for correct grasp to check if upstream ink and downstream ink have viscosity differences developed in between, to thereby provide bases for accurate decisions or determination to be made thereon of or as to, among others, a monitoring period associated with the upper threshold value of the level of ink in the ink tank, or whether or not the differences in flow rate between upstream ink and downstream ink should be reduced.

Further, according to certain embodiments of the present invention, there is a limit value monitor configured to work while the flow rate difference reducer is operating to reduce differences in flow rate between upstream ink and downstream ink, for monitoring the level of ink in the ink tank even in a state thereof having temporarily exceeded the upper threshold value, to grasp the level of ink in the ink tank reaching a limit value. It therefore is possible to take preventive measures before ink overflows from the ink tank.

Further, according to certain embodiments of the present invention, when differences in viscosity are developed between upstream ink and downstream ink, the ink tank is cut off from the atmosphere, so the ink tank is put in a sealed state in which as an air layer is pressure-reduced to a limit, downstream ink undergoes an increased difficulty to supply to the inkjet head.

Therefore, at the ink tank, the residual amount of ink has a decreasing degree thereof made dull relative to an increasing degree thereof, so the residual amount of ink in the ink tank tends to be increased with upstream ink supplied to the ink tank. This arrangement permits deficiencies in amount of residual ink in the ink tank or attendant commingling of air into downstream ink, or such, to be prevented with high accuracies, even under low ink temperatures.

Further, according to certain embodiments of the present invention, there is combination of an upstream heater and a downstream heater configured to output a mutually equalized amount of thermal energy, permitting streams of ink passing through upstream flow paths in an upstream flow path block to receive thermal energy with higher heat transfer efficiencies and more efficiently heated, than streams of ink passing through downstream flow paths in a downstream flow path block. Therefore, upstream ink is faster heated than downstream ink, with viscosities of upstream ink faster lowered than viscosities of downstream ink.

As a result, at the ink tank, the residual amount of ink has a decreasing degree thereof made dull relative to an increasing degree thereof, so the residual amount of ink in the ink tank tends to be increased with upstream ink supplied to the ink tank. This arrangement permits, among others, deficiencies in amount of residual ink in the ink tank or attendant commingling of air into downstream ink to be prevented with high accuracies, with simple configuration free of moving components or controls, even under low ink temperatures.

Further, the upstream flow path block and the downstream flow path block have their flow path sectional areas equivalent to each other, so upstream ink and downstream ink get free of differences in flow rate due to differences in flow path sectional area, after dissolution of differences in viscosity between upstream ink and downstream ink. It therefore is possible to prevent differences in flow rate from being developed between upstream ink and downstream ink due to structural factors of the flow rate difference reducer, in a steady state free of differences in viscosity between upstream ink and downstream ink.

Further, according to certain embodiments of the present invention, the upstream flow path block and the downstream flow path block have arrays of flow paths defined by their flow path sectional areas and positioned at their distances from mating upstream and downstream heaters, which are set to be different, so streams of upstream ink and streams of downstream ink passing through the flow paths are subject to different heating efficiencies. This arrangement permits, among others, deficiencies in amount of residual ink in the ink tank or attendant commingling of air into downstream ink to be prevented even under low ink temperatures, with high accuracies, with a simple configuration free of specific measures such as using materials different in heat transfer coefficients to form the upstream flow path block and the downstream flow path block.

Further, according to certain embodiments of the present invention, the upstream heater and the downstream heater may be joined together to form a single heater. This arrangement permits a common use of upstream heater and downstream heater, allowing for a saved space for installation of heater as well as an inkjet printer down-scaled in its entirety.

Further, according to certain embodiments of the present invention, the upstream heater and the downstream heater may be configured to output different amounts of thermal energy, to have different heating efficiencies between upstream ink and downstream ink, permitting upstream ink to be faster heated, with faster lowered viscosities, than downstream ink.

As a result, at the ink tank, the residual amount of ink has a decreasing degree thereof made dull relative to an increasing degree thereof, so the residual amount of ink in the ink tank tends to be increased with upstream ink supplied to the ink tank. This arrangement permits, among others, deficiencies in amount of residual ink in the ink tank or attendant commingling of air into downstream ink to be prevented with high accuracies, even under low ink temperatures.

Further, according to certain embodiments of the present invention, there may be differences in viscosity developed between upstream ink and downstream ink, and coped with by operation of a main pump combined with additional operation of a subsidiary pump connected in parallel thereto to increase the flow rate of upstream ink. As a result, at the ink tank, the residual amount of ink has a decreasing degree thereof made dull relative to an increasing degree thereof, so the residual amount of ink in the ink tank tends to be increased with upstream ink supplied to the ink tank. This arrangement permits, among others, deficiencies in amount of residual ink in the ink tank or attendant commingling of air into downstream ink to be prevented with high accuracies, even under low ink temperatures.

Such being the case, according to the present invention, it is possible to prevent air from being mingled in streams of ink being supplied to an inkjet head, with high accuracies, even under low ink temperatures.

The present application is based upon and claims the benefit of priority under 35 U.S.C. §119 to Japanese Patent Applications No. 2010-085143, filed on Apr. 1, 2010, the entire content of which is incorporated herein by reference.

What is claimed is:

1. An inkjet printer comprising:

an ink tank configured with an ink layer and an air layer;

an inkjet head configured for ink discharge actions using ink supplied from the ink tank;

an ink circulation route configured for circulation of ink between the inkjet head and the ink tank; and a flow rate difference reducer configured to work when a viscosity of upstream ink being returned from the inkjet head to the ink tank is higher than a viscosity of downstream ink being supplied from the ink tank to the inkjet head, to reduce a flow rate difference developed between upstream ink and downstream ink with a viscosity difference between upstream ink and downstream ink.

2. The inkjet printer according to claim 1, wherein the flow rate difference reducer comprises:

an upstream flow path block configured with an upstream flow path set incorporated therein for upstream ink in the ink circulation route to pass therethrough;

a downstream flow path block configured with a downstream flow path set incorporated therein for downstream ink in the ink circulation route to pass therethrough, the downstream flow path block being equal in flow path sectional area to the upstream flow path block;

an upstream heater configured to heat ink passing through the upstream flow path set; and a downstream heater configured to heat ink passing through the downstream flow path set by equivalent thermal energy to the upstream heater, wherein the upstream flow path block is configured to transfer thermal energy from the upstream heater to ink passing through the upstream flow path set, with a higher efficiency than a transfer efficiency of thermal energy from the downstream heater to ink passing through the downstream flow path set.

3. The inkjet printer according to claim 2, wherein the upstream flow path set comprises:

one or more upstream large flow paths; and one or more upstream small flow paths formed to be smaller in flow path sectional area than the one or more upstream large flow paths, and disposed further off from the upstream heater than the one or more upstream large flow paths, and the downstream flow path set comprises:

one or more downstream small flow paths; and one or more downstream large flow paths formed to be larger in flow path sectional area than the one or more downstream small flow paths, and disposed further off from the downstream heater than the one or more downstream small flow paths, wherein the one or more upstream large flow paths and the one or more upstream small flow paths have a total flow path sectional area thereof equal to a total flow path sectional area of the one or more downstream large flow paths and the one or more downstream small flow paths.

4. The inkjet printer according to claim 1, wherein the flow rate difference reducer comprises:

an upstream heater configured to heat ink being returned from the inkjet head to the ink tank through the ink circulation route; and a downstream heater configured to heat ink being supplied from the ink tank to the inkjet head through the ink circulation route, wherein the upstream heater is configured to work with development of viscosity difference between upstream ink and downstream ink, to output higher thermal energy than the downstream heater.

5. The inkjet printer according to claim 1, wherein the flow rate difference reducer comprises an atmosphere open-close valve configured to shut off the ink tank from atmosphere during operation of the flow rate difference reducer.

6. The inkjet printer according to claim 1, further comprising:

an upper threshold value detector configured to detect an upper threshold value of a liquid level of ink in the ink tank; and an upper threshold value monitor configured to periodically monitor the liquid level of ink to check for an arrival thereof at the upper threshold value based on a result of detection at the upper threshold value detector, wherein the upper threshold value monitor is configured to work when the flow rate difference reducer is operated, to change a monitoring period to a specific period longer than a normal period set when the flow rate difference reducer is kept from operation.

7. The inkjet printer according to claim 6, further comprising one or more temperature detectors configured to detect a temperature of upstream ink and a temperature of downstream ink, wherein the flow rate difference reducer is configured to work on a basis of detection result of the one or more temperature detectors to determine presence or absence of a difference in viscosity between upstream ink and downstream ink, and the upper threshold value monitor is configured to work on the basis of detection result of the one or more temperature detectors to have the normal period or the specific period whichever is set as the monitoring period.

8. The inkjet printer according to claim 6, further comprising:

a limit value detector configured to detect a limit value of liquid level of ink in the ink tank higher than the upper threshold value; and a limit value monitor configured to work on a basis of detection result of the limit value detector to periodically monitor a liquid level of ink reaching the limit value.

9. The inkjet printer according to claim 1, further comprising a main pump configured to return upstream ink from the inkjet head to the ink tank, wherein the flow rate difference reducer further comprises a subsidiary pump configured to work with a difference in viscosity developed between upstream ink and downstream ink, to return upstream ink from the inkjet head to the ink tank, in parallel with the main pump.

* * * * *